United States Patent [19]

Hamaker et al.

[11] 4,197,002

[45] Apr. 8, 1980

[54] PNEUMATIC SYSTEM FOR SUPPORTING AND STEERING A BELT

[75] Inventors: Ralph A. Hamaker, Penfield; Morton Silverberg, Rochester, both of N.Y.

[73] Assignee: Xerox Corporation, Stamford, Conn.

[21] Appl. No.: 960,986

[22] Filed: Nov. 15, 1978

[51] Int. Cl.[2] ..... G03G 15/00; B65H 25/26; B65H 17/32

[52] U.S. Cl. ..... 355/3 BE; 198/811; 226/22; 226/97; 355/16

[58] Field of Search ..... 355/3 R, 3 BE, 3 SH, 355/16; 226/22, 23, 97; 198/811

[56] References Cited

U.S. PATENT DOCUMENTS

| | | | |
|---|---|---|---|
| 3,317,101 | 5/1967 | Himrod et al. | 226/22 X |
| 3,533,542 | 10/1970 | Ziebolz et al. | 226/22 |
| 3,599,851 | 8/1971 | Hedlund et al. | 226/97 |
| 3,726,588 | 4/1973 | Moser | 355/3 BE |
| 3,826,416 | 7/1974 | Takagi et al. | 226/22 |
| 3,964,656 | 6/1976 | Hella | 226/97 |
| 4,043,495 | 8/1977 | Sander | 226/97 X |
| 4,124,156 | 11/1978 | Waffner | 226/25 |

OTHER PUBLICATIONS

Morse et al., "Web Tracking Apparatus," Research Disclosure, pp. 29–31; May 1976; Item No. 14510.

*Primary Examiner*—Fred L. Braun

*Attorney, Agent, or Firm*—J. J. Ralabate; C. A. Green; H. Fleischer

[57] ABSTRACT

An apparatus in which a belt is supported for movement in a pre-determined path. The lateral movement of the belt relative to the pre-determined path is controlled. A pneumatic system provides pressurized fluid to at least partially support the belt and control the lateral movement thereof.

8 Claims, 4 Drawing Figures

PNEUMATIC SYSTEM FOR SUPPORTING AND STEERING A BELT

BACKGROUND OF THE INVENTION

This invention relates generally to an electrophotographic printing machine, and more particularly concerns an improved apparatus for supporting and controlling the lateral movement of a moving photoconductive belt.

In the process of electrophotographic printing, a photoconductive belt is charged to a substantially uniform potential so as to sensitize the surface thereof. Thereafter, the sensitized surface of the photoconductive belt is exposed to a light image of an original document being reproduced. Exposure of the charged portion of the photoconductive belt selectively discharges the charge thereon in the irradiated areas. This records an electrostatic latent image on the photoconductive belt corresponding to the informational areas contained within the original document being reproduced. After the electrostatic latent image is recorded on the photoconductive belt, the latent image is developed by bringing a developer mix into contact therewith. Generally, the developer mix comprises toner particles adhering triboelectrically to carrier granules. The toner particles are attracted from the carrier granules to the latent image so as to form a toner powder image on the photoconductive belt. The toner powder image is then subsequently transferred to a copy sheet. Finally, the copy sheet is heated to permanently affix the toner particles thereto in image configuration. This general approach was originally disclosed by Carlson in U.S. Pat. No. 2,297,691 and has been further amplified and described by many related patents in the art.

The location of the latent image recorded on the photoconductive belt must be precisely defined in order to have the various operating stations act thereon to optimize copy quality. To this end, it is critical that the lateral alignment of the photoconductive belt be controlled within prescribed tolerances. Only in this manner will the photoconductive belt move through a predetermined path so that the processing stations disposed thereabout will be located precisely relative to the latent image recorded thereon.

When considering control of the lateral movement of the photoconductive belt, it is well known that if the belt were constructed and entrained about perfectly cylindrical rollers mounted and secured in an exactly parallel relationship with one another, there would not be any lateral movement of the belt. In actual practice, however, this is not feasible and the location of the photoconductive belt must be controlled to regulate its lateral position.

Accordingly, it is a primary object of the present invention to improve the apparatus for supporting and controlling the lateral movement of the photoconductive belt employed in an electrophotographic printing machine.

PRIOR ART STATEMENT

Various types of devices have hereinbefore been developed to improve the support and tracking of photoconductive belts. The following co-pending U.S. patent application appears to be relevant:

Co-pending U.S. patent application Ser. No. 922,720, filed Aug. 7, 1978.

The pertinent portions of this application may be briefly summarized as follows:

The co-pending application describes an electrophotographic printing machine employing a belt entrained about a steering post. Pressurized fluid is introduced between the steering post and the belt passing thereover so as to form a fluid film therebetween. The fluid film at least partially supports the belt. An aperture is located in the circumference of the steering post and is positioned closely adjacent to the marginal region of the photoconductive belt. A sensing tube extends from the aperture to a bellows. Lateral belt movement introduces changes in coverage of the aperture associated with the sensing tube. This produces pressure changes in the bellows. These pressure changes expand or contract the bellows which, in turn, pivot the steering post to restore the belt to its preferred path.

It is believed that the scope of the present invention, as defined by the appended claims, is patentably distinguishable over the foregoing prior art.

SUMMARY OF THE INVENTION

Briefly stated, and in accordance with the invention, there is provided an apparatus for supporting a belt arranged to move in a pre-determined path and for controlling the lateral movement of the belt from the pre-determined path.

Pursuant to the features of the present invention, the apparatus includes a steering post having the belt moving thereover. The steering post is mounted pivotably about an axis substantially normal to the longitudinal axis thereof. Means supply a pressurized fluid between at least a portion of the steering post and the belt to form a fluid film therebetween. The fluid film at least partially supports the belt and reduces friction between the belt and steering post. Means, in communication with the pressurized fluid supplying means, change the pressure of the fluid from the normal pressure thereof in response to lateral movement of the belt from the predetermined path. A diaphragm, coupled to the steering post, is in communication with the fluid pressure changing means. In this way, the diaphragm pivots the steering post in response to changes in pressure of the fluid from the normal pressure thereof so as to restore the belt to the pre-determined path. Resilient means, coupled to the steering post, oppose the movement of the diaphragm so that the belt moves in the pre-determined path at the normal pressure of the fluid.

BRIEF DESCRIPTION OF THE DRAWINGS

Other objects and advantages of the present invention will become apparent upon reading the following detailed description and upon reference to the drawings, in which.

While the present invention will hereinafter be described in connection with a preferred embodiment thereof, it will be understood that it is not intended to limit the invention to that embodiment. On the contrary, it is intended to cover all alternatives, modifications, and equivalents as may be included within the spirit and scope of the invention as defined by the appended claims.

DETAILED DESCRIPTION OF THE INVENTION

Figure 1:
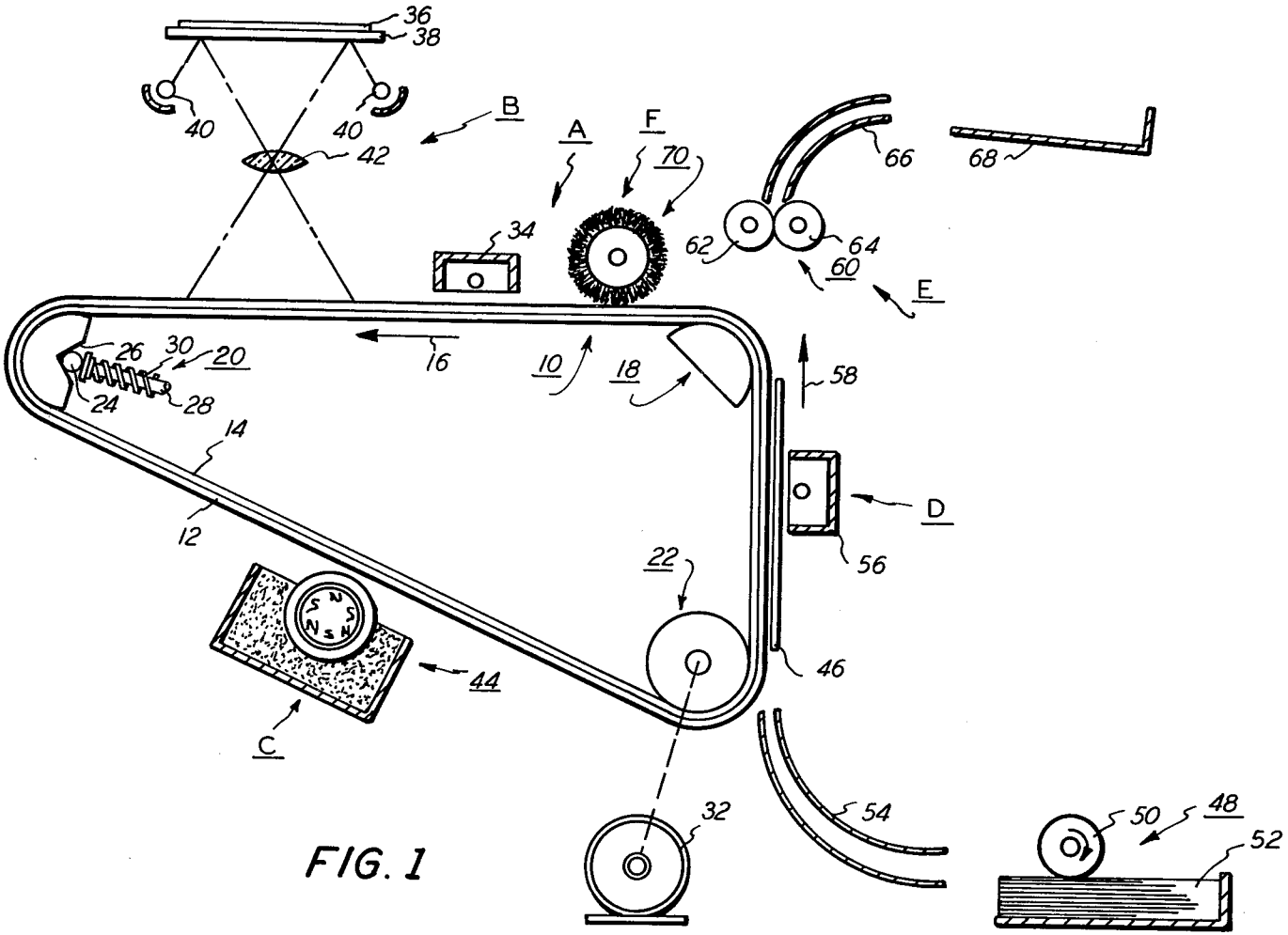
FIG. 1 is a schematic elevational view depicting an electrophotographic printing machine incorporating the features of the present invention therein.

For a general understanding of the illustrative electrophotographic printing machine incorporating the features of the present invention therein, reference is had to the drawings. In the drawings, like reference numerals have been used throughout to designate identical elements. FIG. 1 schematically depicts the various components of the electrophotographic printing machine employing the belt support and steering mechanism of the present invention therein. It will become evident from the following discussion that the belt support and steering mechanism is equally well suited for use in a wide variety of devices and is not necessarily limited in its application to the particular embodiment shown herein.

Inasmuch as the art of electrophotographic printing is well known, the various processing stations employed in the FIG. 1 printing machine will be shown hereinafter schematically and their operation described briefly with reference thereto.

Figures 2, 3, 4:
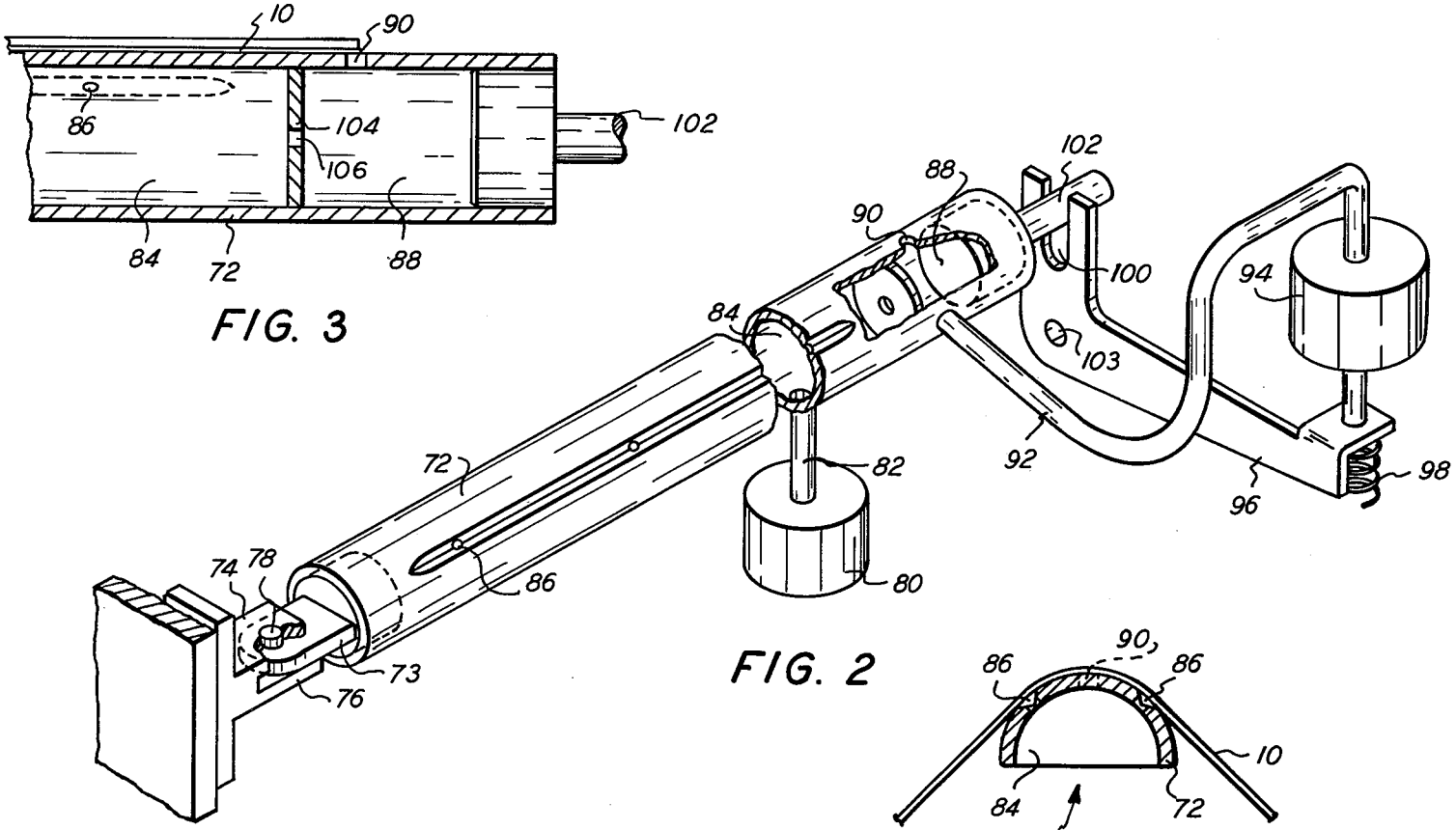
FIG. 2 is a perspective view illustrating the operation of the steering post employed in the FIG. 1 printing machine.
FIG. 3 is a fragmentary sectional elevational view showing the detection of belt lateral movement relative to the FIG. 2 steering post.
FIG. 4 is a sectional elevational view depicting the FIG. 2 steering post supporting the belt.

As shown in FIG. 1, the electrophotographic printing machine employs a belt 10 having a photoconductive surface 12 deposited on a conductive substrate 14. Preferably, photoconductive surface 12 is made from a selenium alloy with conductive substrate 14 being made from an aluminum alloy. Belt 10 moves in the direction of arrow 16 to advance successive portions of photoconductive surface 12 sequentially through the various processing stations disposed about the path of movement thereof. Belt 10 is entrained about steering post 18, tension post 20 and drive roller 22. The detailed structure of steering post 18 will be described hereinafter with reference to FIGS. 2 through 4, inclusive. A spherical member or ball 24 is resiliently biased into contact with groove 26 of post 20 by rod 28 and spring 30. Steering post 18 is mounted pivotably and pivots in a direction to reduce the approach angle of belt 10 to drive roller 22, i.e. the belt velocity vector relative to the normal to the drive roller axis of rotation. This restores belt 10 to the desired path of movement minimizing lateral deviations. Steering post 18 pivots about an axis substantially normal to the longitudinal axis thereof and perpendicular to the plane defined by approaching belt 10. Drive roller 22 is in engagement with belt 10 and advances belt 10 in the direction of arrow 16. Roller 22 is rotated by motor 32 coupled thereto by suitable means such as a belt. A blower system is connected to steering post 18 and tension post 20. The blower system furnishes pressurized fluid, i.e. a compressible gas, preferably air, to both tension post 20 and steering post 18. In this way, a pressurized fluid film is formed between the respective post and belt 20 so as to provide a support therefor and reduce friction between the belt and the post. The details of the fluid support system for steering post 18 are illustrated in FIGS. 2 through 4, inclusive.

With continued reference to FIG. 1, initially a portion of belt 10 passes through charging station A. At charging station A, a corona generating device, indicated generally by the reference numeral 34, charges photoconductive surface 12 of belt 10 to a relatively high, substantially uniform potential. A suitable corona generating device is described in U.S. Pat. No. 2,836,725 issued to Vyverberg in 1958.

Next, the charged portion of photoconductive surface 12 is advanced through exposure station B. At exposure station B, an original document 36 is positioned face-down upon transparent platen 38. Lamps 40 flash light rays onto original document 36. The light rays reflected from original document 36 are transmitted through lens 42 forming a light image thereof. The light image is projected onto the charged portion of photoconductive surface 12 so as to selectively dissipate the charge thereon. This records an electrostatic latent image on photoconductive surface 12 which corresponds to the informational areas contained within original document 36.

Thereafter, belt 10 advances the electrostatic latent image recorded on photoconductive surface 12 to development station C. At development station C, a magnetic brush developer roller 44 advances the developer mix into contact with the electrostatic latent image recorded on photoconductive surface 12 of belt 10. The developer mix comprises carrier granules having toner particles adhering triboelectrically thereto. The magnetic brush developer roller forms a chain-like array of developer mix extending in an outwardly direction therefrom. The developer mix contacts the electrostatic latent image recorded on photoconductive surface 12. The latent image attracts the toner particles from the carrier granules forming a toner powder image on photoconductive surface 12 of belt 10.

The toner powder image recorded on photoconductive surface 12 of belt 10 is then transported to transfer station D. At transfer station D, a sheet of support material 46 is positioned in contact with the toner powder image deposited on photoconductive surface 12. The sheet of support material is advanced to transfer station D by a sheet feeding apparatus 48. Preferably, sheet feeding apparatus 48 includes a feed roll 50 contacting the upper sheet of stack 52. Feed roll 50 rotates so as to advance the uppermost sheet from stack 52 into chute 54. Chute 54 directs the advancing sheet of support material into contact with photoconductive surface 12 of belt 10 in a timed sequence so that the toner powder image developed thereon contacts the advancing sheet of support material at transfer station D.

Transfer station D includes a corona generating device 16 which supplies a spray of ions to the backside of sheet 46. This attracts the toner powder image from photoconductive surface 12 to sheet 46. After transfer, the sheet continues to move in the direction of arrow 58 and is separated from belt 10 by a detack corona generating device (not shown) which neutralizes the charge thereon causing sheet 46 to adhere to belt 10. A conveyor system (not shown) advances the sheet from belt 10 to fusing station E.

Fusing station E includes a fuser assembly, indicated generally by the reference numeral 60, which permanently affixes the transferred toner powder image to sheet 46. Preferably, fuser assembly 60 includes a heated fuser roller 62 and a backup roller 64. Sheet 46 passes between fuser roller 62 and back-up roller 64 with the toner powder image contacting fuser roller 62. In this manner, the toner powder image is permanently affixed to sheet 46. After fusing, chute 66 guides the advancing sheet 46 to catch tray 68 for removal from the printing machine by the operator.

Invariably after the sheet of support material is separated from photoconductive surface 12 of belt 10, some residual particles remain adhering thereto. These residual particles are removed from photoconductive surface 12 at cleaning station F. Cleaning station F includes a rotatably mounted fiberous brush 70 in contact with photoconductive surface 12 of belt 10. The particles are cleaned from photoconductive surface 12 by the rotation of brush 70 in contact therewith. Subsequent to cleaning, a discharge lamp (not shown) floods photoconductive surface 12 with light to dissipate any residual electrostatic charge remaining thereon prior to the charging thereof for the next successive imaging cycle.

It is believed that the foregoing description is sufficient for purposes of the present application to illustrate the general operation of an electrophotographic printing machine.

Referring now to the specific subject matter of the present invention, FIG. 2 depicts steering post 18 employed in the FIG. 1 printing machine.

Turning now to FIG. 2, steering post 18 includes an elongated substantially hemispherical shell 72 having end portion 74 mounted pivotably on a stationary frame. As depicted thereat, end portion 74 includes a flat bar 73. Bar 73 has a hole therethrough, and is interposed between a pair of closely spaced members 74 and 76, respectively. Each of these members have a co-linear hole therein. A pin passes through the holes in member 74, bar 73, and member 76. This permits shell 72 to pivot about an axis substantially normal to the longitudinal axis thereof. Alternatively, shell 72 may be mounted so as to pivot about the center thereof rather than one end portion.

Blower 80 furnishes pressurized air through conduit 82 into a first interior chamber 84 of shell 72. A plurality of apertures in shell 72 permit the pressurized fluid furnished to interior chamber 84 to escape therefrom. The escaping pressurized gas moves into the gap between belt 10 and steering post 18 providing a fluid film therebetween which substantially supports belt 10. First interior chamber 84 is coupled to sensing chamber 88. Sensing chamber 88 includes an aperture 90 disposed closely adjacent to the marginal edge of belt 10. Conduit 92 couples sensing chamber 88 to diaphragm 94. As belt 10 moves laterally, the portion of aperture 90 covered thereby varies. This produces changes in the pressure within chamber 88. These pressure changes are transmitted to diaphragm 94. As a greater portion of aperture 90 is covered by belt 10, the pressure in chamber 88 increases and diaphragm 94 expands. Contrariwise, as the pressure decreases within chamber 88 due to a lesser portion of aperture 90 being covered by belt 10, diaphragm 94 retracts. Inasmuch as diaphragm 94 is connected directly to link 96, any movement thereof will be reflected as movement of link 96.

Diaphragm 94 is connected to one end portion of link 96. Movement of diaphragm 94 is opposed by a spring 98 connected to the same end portion of link 96. The other end portion of link 96 includes a slot 100 supporting end portion 102 of shell 72. Link 96 pivots about point 103. By way of example, a suitable pivoting mechanism comprises a pin passing through a hole in link 96 at point 103. In operation, as diaphragm 94 expands, link 96 pivots in a clockwise direction. This causes belt 10 to move so as to uncover a greater portion of aperture 90 reducing the pressure in chamber 88 and, in turn, the pressure within diaphragm 94. As the pressure within diaphragm 94 is decreased, diaphragm 94 retracts and link 96 pivots in a counterclockwise direction. When approximately one-half of aperture 90 is covered by the marginal end portion of belt 10, the spring force applied by spring 98 on link 96 is balanced by the force applied thereon by diaphragm 94. Thus, when approximately one-half of aperture 90 is covered, a normal condition or normal pressure is developed within sensing chamber 88 and the pressure developed in diaphragm 94 produces a force on link 96 which is balanced by the force on spring 98. In this mode of operation, link 96 is substantially stationary and belt 10 moves along the preferred path of travel. Deviations from the preferred path of travel result in pressure changes in diaphragm 94. These pressure changes produce a pivoting movement of link 96 which causes belt 10 to return to the preferred path of travel.

Referring now to FIG. 3, the operation of sensing chamber 88 will be described hereinafter. As shown in FIG. 3, a wall 104 separates chamber 88 from chamber 84. Wall 104 has an aperture or hole 106 therein. Pressurized fluid is introduced into chamber 84 and escapes therefrom via apertures 86 into the gap between belt 10 and shell 72 providing support for belt 10. However, pressurized fluid also passes through aperture 106 into sensing chamber 88. The pressurized fluid in sensing chamber 88 escapes through aperture 90 and conduit 92 (FIG. 2). Pressure changes are caused by variations in the size of aperture 90. Thus, lateral movement of belt 10 causes the size of the opening through aperture 90 to vary producing pressure changes in chamber 88. These pressure changes, induce movement of diaphragm 94 (FIG. 2) which is opposed by spring 98 (FIG. 2). As previously noted, these pressure changes pivot the steering post which, in turn, returns belt 10 to its preferred path, i.e. where approximately one-half of aperture 90 remains uncovered by belt 10. Under these latter circumstances a normal pressure condition is introduced within chamber 88 and the force exerted by diaphragm 94 on link 96 is balanced by the force of spring 98.

Referring now to FIG. 4, there is shown the detailed structure of steering post 18 and the manner in which it provides support for belt 10. As depicted thereat, shell 72 includes two sets of apertures rotated relative to one another and positioned substantially at tangency points of belt 10. Each set of apertures includes a plurality of apertures 86. Pressurized fluid from chamber 84 egresses through apertures 86 into the gap between belt 10 and the surface of shell 72. The escaping fluid forms a film which at least partially supports belt 10. Aperture 90 which substantially bisects the angle between the two sets of apertures 86, is located in communication with sensing chamber 88 and has a portion thereof covered by the marginal edge portion of belt 10. Sensing chamber 88 provides little or no support for belt 10. However, as belt 10 moves, the portion of aperture 90 covered thereby varies. This introduces pressure changes within sensing chamber 88 which, in turn, causes steering moments to be applied to steering post 18 so as to restore belt 10 to the preferred path of travel.

In recapitulation, it is evident that the apparatus of the present invention provides steering and support for a belt employed in an electrophotographic printing machine. As hereinbefore described, the steering post is pivoted about one end thereof and has forces exerted thereon at the other end. These forces introduce moments on the steering post, which in turn, restore the belt to the preferred path of travel. Steering moments are caused by pressure changes due to lateral movement of the belt which are sensed and converted into forces which pivot the steering post so as to correct lateral deviation of the belt from the preferred path of travel. In addition to the pneumatic system providing a structure for detecting belt lateral movement and a means for correction thereof, the system also provides belt support. The pressurized fluid forms a fluid film between the steering post and the belt. This fluid film significantly reduces friction so as to improve overall operation of the belt system.

It is, therefore, evident that there has been provided in accordance with present invention, an apparatus for supporting and steering a belt employed in an electrophotographic printing machine. This apparatus fully satisfies the objects, aims and advantages hereinbefore set forth. While this invention has been described in conjunction with a specific embodiment thereof, it is evident that many alternatives, modifications, and variations will be apparent to those skilled in the art. Accordingly, it is intended to embrace all such alternatives, modifications, and variations as fall within the spirit and broad scope of the appended claims.

What is claimed is:

1. An apparatus for supporting a belt arranged to move in a pre-determined path and for controlling the lateral movement of the belt from the pre-determined path, including:

means for supplying a pressurized fluid;

a pivotably mounted steering post having the belt moving thereover, said steering post defining a first interior chamber in communication with said supplying means and having a plurality of spaced apertures in the surface thereof so that the pressurized fluid introduced into the first interior chamber flows through the spaced apertures to form a fluid film between said steering post and the portion of the belt passing thereover to at least partially support the belt and reduce friction between the belt and said steering post, said steering post defining a second interior chamber coupled to the first interior chamber with said steering post having a sensing aperture in the surface thereof in communication with the second interior chamber and disposed beneath one side marginal region of the belt so that lateral movement of the belt changes the pressure in the second interior chamber by varying the portion of the sensing aperture covered by the belt with the belt covering a pre-determined portion of the sensing aperture at the normal fluid pressure;

a diaphragm coupled to said steering post and in communication with the second interior chamber of said steering post so as to pivot said steering post in response to changes in pressure of fluid from the normal pressure thereof so as to restore the belt to the pre-determined path; and resilient means coupled to said steering post and opposing the movement of said diaphragm so that the belt moves in the pre-determined path at the normal pressure of the fluid.

2. An apparatus as recited in claim 1, further including:

means for securing pivotably one end portion of said steering post; and means for securing slidably the other end portion of said steering post, said securing means being connected to said diaphragm and said resilient means.

3. An apparatus as recited in claim 2, further including:

a tension post having the belt passing thereover; and at least one spring urging said tension post to maintain the belt passing thereover under tension.

4. An apparatus as recited in claim 2, further including:

a drive roller in engagement with said belt; and means for rotating said drive roller to move the belt.

5. An electrophotographic printing machine of the type having an endless photoconductive belt arranged to have a latent image of an original document being reproduced recorded thereon, wherein the improvement includes:

means for moving the belt:

means for supplying a pressurized fluid;

a pivotably mounted steering post having the belt moving thereover, said steering post defining a first interior chamber in communication with said supplying means and having a plurality of spaced apertures in the surface thereof so that the pressurized fluid introduced into the first chamber flows through the spaced apertures to form a fluid film between said steering post and the portions of the belt passing thereover to at least partially support the belt and reduce friction between the belt and said steering post, said steering post defining a second interior chamber coupled to the first interior chamber with said steering post having a sensing aperture in the surface thereof in communication with the second interior chamber and disposed beneath one side marginal region of the belt so that lateral movement of the belt changes the pressure in the second interior chamber by varying the portion of the sensing aperture covered by the belt with the belt covering a pre-determined portion of the sensing aperture at the normal fluid pressure;

a diaphragm coupled to said steering post and in communication with the second interior chamber of said steering post so as to pivot said steering post in response to changes in pressure of the fluid from the normal pressure thereof so as to restore the belt to the pre-determined path; and resilient means coupled to said steering post and opposing the movement of said diaphragm so that the belt moves in the pre-determined path at the normal pressure of the fluid.

6. A printing machine as recited in claim 5, further including:

means for securing pivotably one end portion of said steering post; and means for securing slidably the other end portion of said steering post, said securing means being connected to said diaphragm and said resilient means.

7. A printing machine as recited in claim 6, further including:

a tension post having the belt passing thereover; and at least one spring urging said tension post to maintain the belt passing thereover under tension.

8. A printing machine as recited in claim 6, wherein said moving means includes:

a drive roller in engagement with said belt; and means for rotating said drive roller to move the belt.

* * * * *